United States Patent [19]

Lechon et al.

[11] Patent Number: 4,640,096

[45] Date of Patent: Feb. 3, 1987

[54] LOAD CARRYING CONNECTION AND HYDRAULIC FLUID TRANSMISSION DEVICE

[75] Inventors: Alain Lechon, Pau; Alain Viard, Muret, both of France

[73] Assignee: Societe Nationale Elf Aquitaine (Production), France

[21] Appl. No.: 673,047

[22] Filed: Nov. 19, 1984

[30] Foreign Application Priority Data

Nov. 21, 1983 [FR] France ..... 83 18459

[51] Int. Cl.[4] ..... B60T 13/00; E03B 37/00

[52] U.S. Cl. ..... 60/547.1; 137/236.1; 137/614.03; 285/137.2; 166/344

[58] Field of Search ..... 285/137.2; 137/236.1, 137/614, 614.01, 614.03, 614.04; 60/547.1; 166/344

[56] References Cited

U.S. PATENT DOCUMENTS

| | | | |
|---|---|---|---|
| 3,090,437 | 5/1963 | Geer | 137/236.1 |
| 3,509,910 | 5/1970 | Nelson et al. | 137/236.1 |
| 3,840,071 | 10/1974 | Baugh | 166/344 |
| 4,285,364 | 8/1981 | Hawker | 137/614.03 |
| 4,328,826 | 5/1982 | Baugh | 137/236.1 |
| 4,347,900 | 9/1982 | Barrington | 251/57 |

*Primary Examiner*—A. Michael Chambers

*Attorney, Agent, or Firm*—Poms, Smith, Lande & Rose

[57] ABSTRACT

The device comprises a head 1 containing a cavity 2 and a sleeve 4, and a hollow body 3, inside which is lockingly housed a hollow mandril 6 fixed to a load to be carried and comprising a valving piston 17. Inside sleeve 4 is housed a mobile piston 31 whose head 32 slides in cavity 2. Pipes 27, 28, 29 pass through the cavity 2, whereas, opposite these pipes, housings 320 are formed in the piston 31 for allowing the piston to slide along the pipes. These housings are extended by ducts 33, 34, 35 opening laterally into the face of the piston 31 through orifices 36, 37. Inside mandril 6 are provided longitudinal high pressure fluid ducts 39, 40 for connection to the user circuits. The lateral face of the valving piston 17 comprises annular seals 44, 45, 46 intended to close off, in the raised position of piston 31, the annular zones corresponding to the orifices through which ducts 39, 40 open out and which communicate in the low position of 31 with the orifices 36, 37. The device provides sealing connection of hydraulic circuits and protection of the parts of loads carried against corrosion of the environment.

12 Claims, 2 Drawing Figures

LOAD CARRYING CONNECTION AND HYDRAULIC FLUID TRANSMISSION DEVICE

Figure 1:
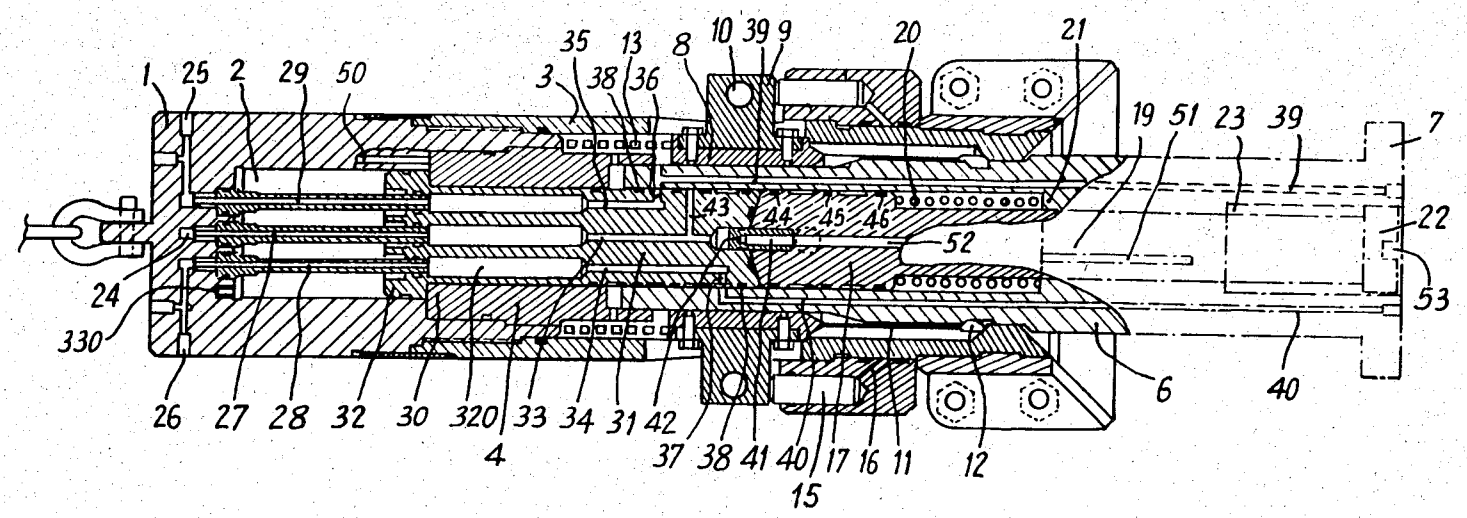

The present invention relates to a load carrying connection device comprising a self locking connector and a mandril integral with the loads to be carried, adapted for transmitting hydraulic pressures and flows through the mandril.

Connectors of this type able to carry very heavy loads are intended to be used in sub-sea oil production stations at a great depth, where the operations must be carried out by remote control without intervention by man.

Consequently, such a device must be able, after having been lowered to the sea bed in the vicinity of the sub-sea installations, for example by means of a stringer train, to mechanically grip and lock parts of the installation comprising a mandril of a type suited to the design of the connector then, after self locking, to transmit hydraulic power through the mandril to the manipulated object, for example for activating a mechanism, such as opening and closing of valves or, more simply, for filling with oil a cavity containing parts likely to be corroded so as to protect them from corrosion.

In most connectors of this type, presentation of the connector on its mandril is often violent and risks damaging the system of seals used. The defective sealing causes other disadvantages, for example the pressurizing of one circuit may cause pressurization of an adjacent circuit.

Moreover, the systems used leave hydraulic circuits and the control members in contact with the sea water, in particular when approaching the connector to the submerged mandril.

The invention provides then a connecting device not having these drawbacks. It is characterized in that it comprises a connecting head containing a cylindrical chamber for housing a piston head and being extended by a hollow connecting body having at its inner periphery means for mechanical locking of the mandril, a hollow mandril, inside which is retained a valving piston having annular seals at its periphery and urged in the direction of the connector by a return spring, and a mobile piston having annular seals at its periphery and whose head is slidingly engaged in the cylindrical chamber of the head of the connector and whose remaining part is engaged inside the connector body, so that the end face of the mobile piston bears on the front face of the valving piston, in that hydraulic fluid ducts pass longitudinally through the cylindrical chamber whereas, over a corresponding length of these ducts, longitudinal housings are formed in the mobile piston so that the ducts may penetrate therein during the stroke of the mobile piston, so that said longitudinal housings communicate with corresponding ducts housed in the remaining part of the mobile piston and which open to orifices in its lateral periphery, so that longitudinal ducts for hydraulic fluids are formed in the hollow shell of the mandril and which open through orifices at its inner periphery and lead towards the end of the mandril for fluid transmission to the loads carried by the mandril, the axial dimensions of the head and of the connector body, those of the mobile piston and of the mandril, as well as the locations of the orifices through which the ducts of the mobile piston and the ducts of the mandril open being such that, when the mobile piston is in its low position, these orifices communicate mutually with each other and, when the mobile piston followed by the valving piston is in the top position, the annular zones of the duct orifices of the mandril are closed by the annular seals spaced apart along the lateral face of the valving piston on each side of the zones. Preferably, the annular zones of the orifices through which the ducts open to the outside are isolated by annular seals spaced apart on each side of the zones along the periphery of the mobile piston. In fact, because of the arrangement comprising, on the one hand, a mobile piston retained in the body of the connector and, on the other hand, a valving piston retained in the body of the mandril and because of a judicious arrangement of annular seals, the hydraulic circuits of the connector and those of the mandril remain isolated from the sea water not only during the connected and locked phase but also when the connector is separated from the mandril and their hollow and projecting parts are exposed to the sea water environment.

In a preferred embodiment, the cylindrical chamber of the head of the connector has passing therethrough two ducts connected respectively to the intake and to the return of high pressure hydraulic fluid, which are able to communicate through two housings of the mobile piston, in the low position, with two ducts in the shell of the mandril, whereas a third duct for low pressure fluid passes axially through said chamber and opens, through a similar housing formed in the mobile piston and a duct, in the axis of the end face of the piston for communicating with an axial duct formed in the valving piston for transmitting low pressure fluid through the mandril to the load carried by the mandril.

Other features of the device of the invention will be clear from the description of one embodiment illustrated by way of example.

Figure 2:
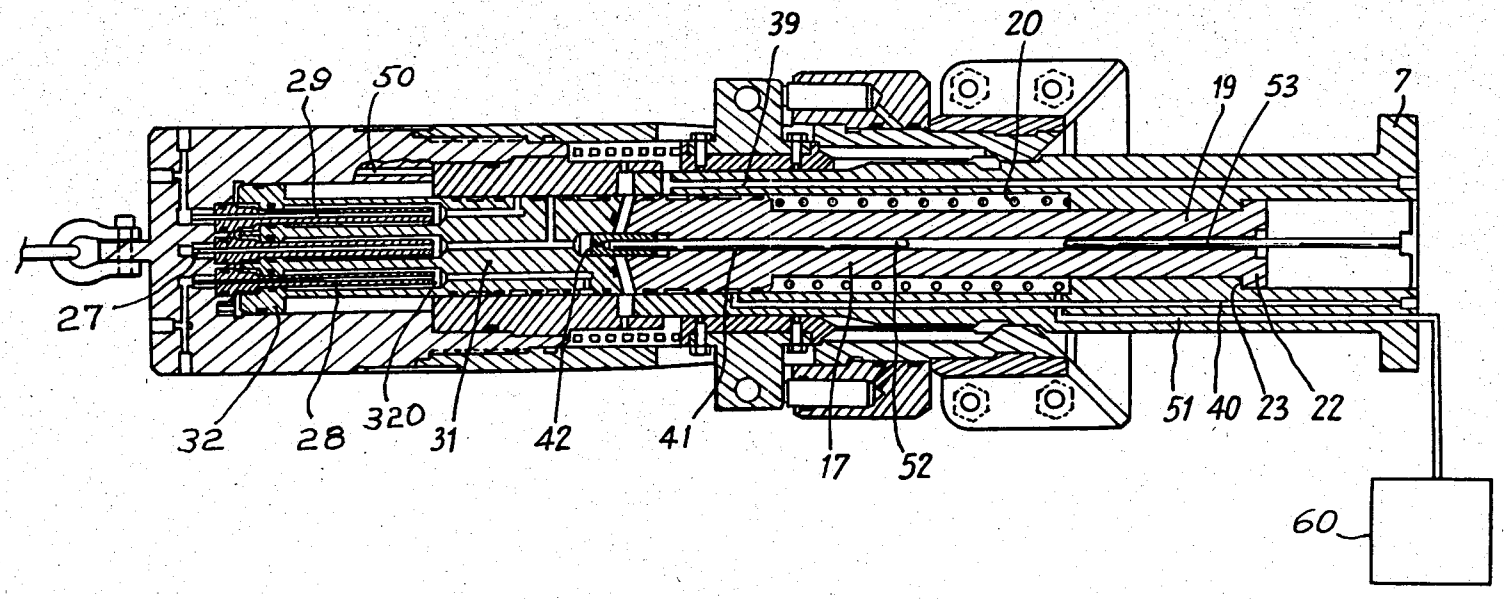

FIG. 1 is a sectional view of a connector device embodying the invention, the connector device being shown with the mobile and valving pistons in bottom position (that is to the right of the figure.) FIG. 2 is a sectional view of the device shown in FIG. 1 in which the mobile and valving pistons are shown in upper position.

The connector comprises a connecting head 1 fitted with a hook and containing a cylindrical cavity 2 and a hollow connector body 3 connected to the head 1 and inside which is placed a sleeve 4.

The axial space inside the connector body 3 is intended for housing a hollow mandril 6 with flange 7 for fixing to any load to be handled, for example a multi-connector forming part of the equipment of a sub-sea oil production station.

The means for mechanical locking of mandril 6 are conventional means housed in the low part of the connector body following sleeve 4 and comprising a sleeve 8 housed in an opening of body 3, urged by a spring 13 and integral with unlocking blocks 9 pierced with apertures 10. Sleeve 8 comprises resilient blades 11, commonly called dogs, whose ends 12 engage in housings with which the outer face of mandril 6 is provided, when the mandril is introduced into the connector body. Furthermore, these locking means comprise, fixed to the outside of body 3 and in the vicinity of blocks 9, a ring shaped unlocking device 14 housing two pistons 15 and comprising an intake 16 for the fluid acting on the pistons.

Inside the hollow mandril 6 is placed a valving piston 17. Annular seals 44, 45 and 46 are spaced apart along the lateral face of the piston. The piston forming part 7 is extended by a rod 19 and spring 20 surrounds this rod while bearing on an inner shoulder 21 of the mandril for exerting a thrust on piston 17 towards the open end of the mandril. Rod 19 ends in a retaining stop 22 housed in a cavity close to flange 7 and comprising a retaining shoulder 23 for limiting the travel of piston 17.

The locking system operates in the following known way. Mandril 6 is introduced into the body of connector 3, the dogs 12 move resilient apart until they meet the locking housing with which the outer face of the mandril is provided. For unlocking the connection, an axial thrust is exerted on piston 15 by means of hydraulic fluid arriving at 16, which pushes the unlocking block 9 and at the same time moves blades 11 apart. Apertures 10 allow such an action to be accomplished manually.

In th head of connector 1 are housed ducts for the hydraulic fluid and, in particular, in the axis of the head an intake 24 for the low pressure fluid and two ducts 25 and 26 spaced apart excentrically and connected to a pressurized fluid distributor for the intake and return of high pressure fluid.

These ducts 24, 25 and 26 are connected to pipes, respectively, 27, 28 and 29 emerging axially into the cylindrical cavity 2 which is defined by an annular shoulder 30 formed by the front face of sleeve 4. Inside sleeve 4 is housed a mobile piston 31 whose head 32 is able to slide in cavity 2. The length of piston 31 exceeds the length of sleeve 4 and its lower part is intended to slide inside the hollow mandril 6. In piston 31, opposite pipes 27, 28 and 29, are provided cylindrical housings 320 thus allowing the piston to slide along these pipes. A hydraulic fluid intake 330 opens into cavity 2 for actuating the stoke of the piston. A second intake of pressurized fluid 50 is provided for opening into chamber 2 and exerting a thrust on the opposite face of the piston so as to cause it to rise up.

The cylindrical housings 320 are extended inside the piston by ducts 33, 34 and 35. The high pressure fluid ducts 34 and 35 open laterally into the outer face of piston 31, more particularly in its sliding part inside the hollow mandril 6, comprising annular seals 38, through axially offset orifices 36 and 37.

Inside mandril 6 are provided longitudinal ducts 39 and 40 for the high pressure fluid ending in flange 7, from which these ducts are connected to internal user circuits, for example to the multiconnectors. These ducts open via lateral bypasses through orifices offset axially towards the hollow part of the mandril, in which piston 31 is placed.

The valving piston 17 held to the mandril because of stop 22 at the end of rod 19 in a housing close to flange 7, is also able to slide inside the hollow mandril 6 and in its axis there is provided a low pressure fluid duct 41 opening into the front face of the piston through a non return valve 42. Duct 33 housed axially in the mobile piston 31 may thus be connected to duct 41 for the transmission of low pressure fluid through mandril 6 because of the seal placed at the foot of piston 31. This fluid may be used as fluid for protecting parts likely to be damaged by corrosion, such as multiconnector parts. The non return valve 42 urged into a closure position by a spring opens under the effect of the thrust from rod 52 housed in duct 41 and bearing on a rod 53 integral with flange 7, when piston 17 is at the bottom end of its stroke, pushed by piston 31.

A duct 51 connected to an oleo-pneumatic accumulator 60, opens into a cavity defined by an opposite face of piston 17 for assisting its rising movement.

Duct 33 is provided with a lateral bypass 43 opening into the annular space between orifices 36 and 37 at the outer periphery or piston 17 and forms a drainage passage between the annular zones 36 and 37 into which the high pressure circuits emerge, so that should a leak occur or should the seals 38 situated on each side of bypass 43 be destroyed, the high pressure circuits are not mixed an any leak is immediately drained towards the low pressure circuit through duct 43.

The lateral face of the valving piston 17 comprises annular seals 44, 45 and 46 for closing off, in the raised position of piston 31, the annular zones corresponding to the orifices through which the high pressure ducts 39 an 40 emerge and which communicate, in the low position of piston 31, with the orifices 36 and 37 of this same piston.

The connection of mandril 6 to the body of connector 3 and of the ducts for the hydraulic fluids is achieved in the following way.

The mandril firmly fixed by flange 7 to its load is introduced inside the connector body 3, until mechanical locking by dogs 11 and 12 is obtained, the mobile piston 31 being in its top position and the valving piston 17 being pushed upwardly by springs 20, possibly aided by the pressure of a fluid from an oleo-pneumatic accumulator 60, opening into duct 51, and seals 44, 45 and 46 closing off the annular zones of the corresponding orifices 39 and 40 of the mandril. Valve 42 closes off the central passage 41.

The hydraulic fluid pressure is admitted through 330, the piston 31 moves down until the piston head 32 bears on the annular shoulder 30, exerts a thrust on the face of the valving piston 17 which compresses springs 20 and forces the oil situated in the housing of spring 20 into the oleo-pneumatic accumulator.

At this stage, piston 31 places orifices 36 and 37 in communication with the corresponding ducts 39 and 40 of the mandril, an also the orifice of duct 33 with duct 41 of the valving piston 17, because of the opening of valve 42 by rod 52 situated inside duct 41 and bearing at the end of travel on rod 53 integral with the junction face of mandril 6 with flange 7. With piston 31 in abutment and mandril 6 bearing on dogs 12, the correct positioning of ducts 36 and 37 for communication with ducts 39 and 40 is therefore ensured.

The pressure of high pressure fluid is admitted through one of the intakes 25 or 26, so that the energy is transferred from the connector to the load carried by the mandril. Once the action controlled by said hydraulic fluid is finished, the intake through 25 or 26 is stopped and a low pressure fluid is admitted through intake 24 for filling, for example, a cavity of the multiconnector and protecting its parts against corrosion. Because of the non return valve 42, this fluid remains permanently in said cavity. Once the operation is finished, the intake at 24 is stopped, the pressure of the fluid admitted through 330 is relieved, the intake is opened on the lower face of head 32 through duct 50 and piston 31 rises again accompanied in its travel by piston 17 urged by spring 20 and assisted by the fluid of the accumulator exerting a thrust on the piston via duct 51, said spring not being able to exert an action sufficient for overcoming the friction caused by seals 44, 45 and 46. With piston 17 in its top position, seals 44, 45 and 46 efficiently close off the annular zones of the orifices through which ducts 39 and 40 open out, whereas seals 38 isolate circuits 33, 34 and 35 from any contact with sea water.

Hydraulic connection and disconnection can therefore be achieved without pollution of the hydraulic circuits by the sea water. The closure of the cavity of the multiconnector filled with protection fluid takes place automatically when the valving piston 17 rises under the effect of the thrust exerted by spring 20 and the fluid of the oleo-pneumatic accumulator. In fact, rod 53 integral with flange 7 ceases to push back rod 52 sliding inside piston 7 in duct 41 and which maintained valve 42 open. Under the effect of its spring, valve 42, closes, which traps the low pressure oil injected which, less dense than water, would tend to escape to the surface of the sea.

We claim:

1. A load carrying connection device comprising a selflocking connector and a mandril firmly secured to loads to be carried and adapted to transmit hydraulic pressures and flows through the mandril, comprising in combination:

a connector head (1) including a hollow connector body (3) and an internal sleeve (4) providing an elongated chamber (2);

a hollow mandril extending into said connector body (3) and adapted to be locked to said connector head (1);

a valving piston (17) having a front face carried within said mandril (6) and provided with a plurality of annular axially spaced seals (44, 45, 46) at its periphery, a return spring (20) in said mandril for biasing said valving piston toward said connector head (1);

a mobile piston (31) slidable with said chamber (2) and having a piston head (32) movable in said chamber (2) and limited in a bottom position by said internal sleeve (4), said mobile piston (31) having a lower portion within connector body (3) and having an end face adapted to bear on said front face of said valving piston (17) within said mandril (6);

duct means for flow of hydraulic fluid between said connector head (1) and said mandril (6) including ducts (27, 28 and 29) is said chamber (2), and passing through said head (32), corresponding housings (320) in said mobile piston (31) for receiving said ducts (27, 28) and (29) when said mobile piston is in top position;

said mobile piston (31) having corresponding ducts (34, 35) provided wih orifices (36, 37) at its lateral periphery for communication with longitudinal ducts (39, 40) in the mandril (6) for transmission of pressure fluid to the loads carried by the mandril, whereby when said mobile piston (31) is in said bottom position, said orifices (36, 37) communicate mutually together and when the mobile piston (31) is followed by said valving piston (17) in top position of said mobile piston (31), the annular zones of said orifices (36, 37) of ducts (39, 40) of the mandril are closed by said annular seals (44, 45, 46) spaced apart along the lateral face of the valve piston (17) on each side of said annular zones of said duct orifices.

2. Device according to claim 1 characterized in that said lower portion of the mobile piston 31 comprises annular seals 38 within said body 3 and in slidable contact with said sleeve 4 in top position of said mobile piston 31.

3. Device according to claim 2, characterized in that in the top position of the mobile piston engaged in the sleeve (4), the annular zones of the orifices (36, 37) through which the ducts (34, 35) open to the outside, are isolated by annular seals (38) spaced apart on ecah side of these zones along the periphery of the mobile piston (31).

4. A device according to claim 2 characterized in that said two ducts (28, 29) are connected respectively to an intake (25) and to a return 26 of the high pressure hydraulic fluid, passed through the cylindrical chamber (2) of the head of the connector (1) and in low position of the mobile piston, communicate via two of said housings 320 in the mobile piston with two ducts 39, 40 provided in the hollow shell of the mandril (6) and having openings at the inner periphery of the mandril 6.

5. A device according to claim 1, characterized in that a duct (27) for a low pressure fluid passes axially through the cylindrical chamber (2) an opens, via one of said housings (320) and an axial duct (33) both passing through the mobile piston (31), into the axis of the end-face of the piston (31) for communicating with an axial duct (41) formed in the valving piston (17) for transmitting low pressure fluid through the mandril towards the load carried by the mandril.

6. Device according to claim 5, characterized in that the axial duct (33) of the mobile piston (31) is provided with a lateral bypass (43) opening into the annular space between the orifices (36, 37) at the outer periphery of the piston (17) and forming a drainage passage between the annular zones of the orifices (36, 37) where the high pressure circuits open out, so that should a leak occur or should the seals (38) situated on each side of the bypass (43) be destroyed, the high pressure circuits are not mixed and any leak is immediately drained towards the low pressure circuit through duct (43).

7. A device according to claim 5 characterized in that a duct (41) is formed in the valving piston (17) and houses a valving device 42, whose nonreturn valve (42) urged to closure by a spring, opens under the effect of a thrust of a rod (52) bearing on a rod (53) integral with the flange (7) and opposing the action of a spring, when the piston (31) exerts during its downward movement a thrust on pison (17), this latter being at the end of travel, of piston 31, and spring 20 being compressed.

8. Device according to claim 1, characterized in that the valving piston (17) end on the same side as its end opposite that which bears against the mobile piston (33) in a retaining stop housed in a cavity close to the flange (7) and having a retaining shoulder (23) for limiting the travel of the piston (17).

9. Device according to claim 1, characterized in that the chamber (2) of the connector head is connected to a first intake (330) of pressurized fluid intended to exert a thrust on the front face of the head (32) of the piston (31) in the downward direction and a second intake (50) for pressurized fluid exerting its thrust on the opposite face of piston head (32) for causing head 32 to rise.

10. Device according to claim 1, characterized in that rising of the valving piston (17) urged by spring (20) is assisted by the action of a fluid coming from an accumulator and which exerts a thrust on the piston via a duct (51) formed inside the piston.

11. A load carrying connection device for transmitting fluid under pressure therethrough, comprising in combination:

a connector head means providing an elongated hollow chamber having an opening at one end and a closure at the other end;

a plurality of fluid conducting ducts in said chamber extending axially from said closure;

a hollow mandril received within the open end of said chamber an adapted to be locked to said connector head means;

a mobile piston longitudinally slidable within said chamber and having a piston head provided with openings for reception of said fluid conducting ducts in said chamber, said mobile piston having internal housings for reception of said fluid ducts, stop means on said connector head means for limiting travel of said piston head toward the open end of said chamber;

said mobile piston having a lower end portion slidably receivable within said hollow manril;

a valving piston slidable within said hollow mandril and having an end face adapted to seat on an opposed end face of said mobile piston in one position of the mobile piston;

spring means in said hollow mandril for biasing said valving piston into said seating position against the face of the mobile piston;

passageway means in said mobile piston and in said mandril for communication of pressure fluid when said mobile piston is in bottom position, said passageway means including passageways in said mobile piston communicating with said housings;

and seal means on said lower portion of said mobile piston and on said valving piston for isolating said passageway means when said mobile piston nad valving piston are in their upper position.

12. A device as claimed in claim 11 wherein said passageway means includes a passageway in said mobile piston communicating with one of said housings therein;

and a valve device at the interface of said valving and mobile pistons for limiting flow of pressure fluid to one direction.

* * * * *